US009535392B2

(12) United States Patent
Yamamoto

(10) Patent No.: US 9,535,392 B2
(45) Date of Patent: Jan. 3, 2017

(54) IMAGE FORMING APPARATUS HAVING CASING AND RETAINING MECHANISM CONFIGURED TO RETAIN COVER AT POSITION EXPOSING CASING

(71) Applicant: Brother Kogyo Kabushiki Kaisha, Nagoya-shi, Aichi-ken (JP)

(72) Inventor: Koyo Yamamoto, Nisshin (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/757,564

(22) Filed: Dec. 24, 2015

(65) Prior Publication Data

US 2016/0187843 A1 Jun. 30, 2016

(30) Foreign Application Priority Data

Dec. 26, 2014 (JP) ..... 2014-264793

(51) Int. Cl.
*G03G 15/00* (2006.01)
*G03G 21/16* (2006.01)

(52) U.S. Cl.
CPC ..... *G03G 21/1661* (2013.01); *G03G 21/1619* (2013.01)

(58) Field of Classification Search
CPC ..... G03G 21/1661; G03G 21/1619; G03G 21/1623; G03G 21/1628; G03G 21/1633
USPC ..... 399/110, 125, 107
See application file for complete search history.

(56) References Cited

U.S. PATENT DOCUMENTS 8,837,121 B2 9/2014 Yamamoto
8,908,233 B2 * 12/2014 Ohama ..... B41J 29/13 271/10.01
2011/0205692 A1 8/2011 Yamamoto

FOREIGN PATENT DOCUMENTS

JP 2002-370761 A 12/2002
JP 2011-174492 A 9/2011
JP 2014-115573 A 6/2014

OTHER PUBLICATIONS

English machine translation of JP 2001-370761 published on Dec. 24, 2002.*

* cited by examiner

*Primary Examiner* — Billy Lactaoen
(74) *Attorney, Agent, or Firm* — Banner & Witcoff, Ltd.

(57) ABSTRACT

An image forming apparatus includes a casing, a cover configured to pivot between a covering position and an exposing position, a shaft portion provided to one of the casing and the cover, a bearing portion provided to the other one, and a retaining mechanism configured to retain the cover at the exposing position. The cover includes a contactable portion configured to, when the cover pivots between the covering position and the exposing position, contact the retaining mechanism. The retaining mechanism includes a retaining member configured to restrict the cover from pivoting from the exposing position to the covering position, and an urging member urging the retaining member toward the contactable portion. The casing includes a frame, the frame including a guide section configured to guide a sheet. The frame of the casing includes one of the shaft portion and the bearing portion and supports the retaining mechanism.

12 Claims, 10 Drawing Sheets

1

FRONT
LEFT
RIGHT
REAR

IMAGE FORMING APPARATUS HAVING CASING AND RETAINING MECHANISM CONFIGURED TO RETAIN COVER AT POSITION EXPOSING CASING

CROSS-REFERENCE TO RELATED APPLICATION

This application claims priority from Japanese Patent Application No. 2014-264793, filed on Dec. 26, 2014, which is incorporated herein by reference in its entirety.

TECHNICAL FIELD

Aspects described herein relate to an electrophotographic image forming apparatus.

BACKGROUND

A known electrophotographic image forming apparatus includes a body casing and a top cover. The body casing has an upwardly open opening. The top cover is disposed at an upper end of the body casing and is configured to expose and cover the opening. In such an image forming apparatus, the opening is exposed by opening of the top cover and maintenance, e.g., cartridge replacement or removal of a jammed sheet, is performed through the exposed opening. Therefore, it is desired that an unexpected closing of the top cover during maintenance is avoided.

In order to avoid the unexpected closing of the top cover, for example, some known printer includes a retaining mechanism that is configured to retain the top cover at an exposing position where the opening is exposed.

In such a printer, a retaining member of the retaining mechanism is urged upward by a spring member to contact a contactable portion of the top cover from below, thereby retaining the top cover at the exposing position.

SUMMARY

In the known printer, the retaining mechanism may be supported by a rear frame of the body casing and the top cover may be pivotably supported by side frames of the body casing.

Nevertheless, such a structure may cause deformation in the rear frame due to an urging force of the spring member urging the retaining member upward.

Accordingly, some embodiments of the disclosure provide for an image forming apparatus in which deformation of a frame may be reduced or prevented.

According to an aspect of the disclosure, an image forming apparatus includes a casing, a cover configured to pivot between a covering position in which the cover covers an upper end portion of the casing and an exposing position in which the cover exposes the upper end portion of the casing, a shaft portion provided to one of the casing and the cover, a bearing portion provided to the other one of the casing and the cover, and a retaining mechanism configured to retain the cover at the exposing position. The cover includes a contactable portion configured to, when the cover pivots between the covering position and the exposing position, contact the retaining mechanism. The retaining mechanism includes a retaining member and an urging member, the retaining member being configured to restrict the cover from pivoting from the exposing position to the covering position, the urging member urging the retaining member toward the contactable portion. The casing includes a frame, the frame including a guide section configured to guide a sheet. The frame of the casing includes one of the shaft portion and the bearing portion and supports the retaining mechanism.

According to the image forming apparatus, while the cover is retained at the exposing position, a conveyance accuracy of a recording medium may be improved.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION

1. Overall Configuration of Printer

Figure 1:
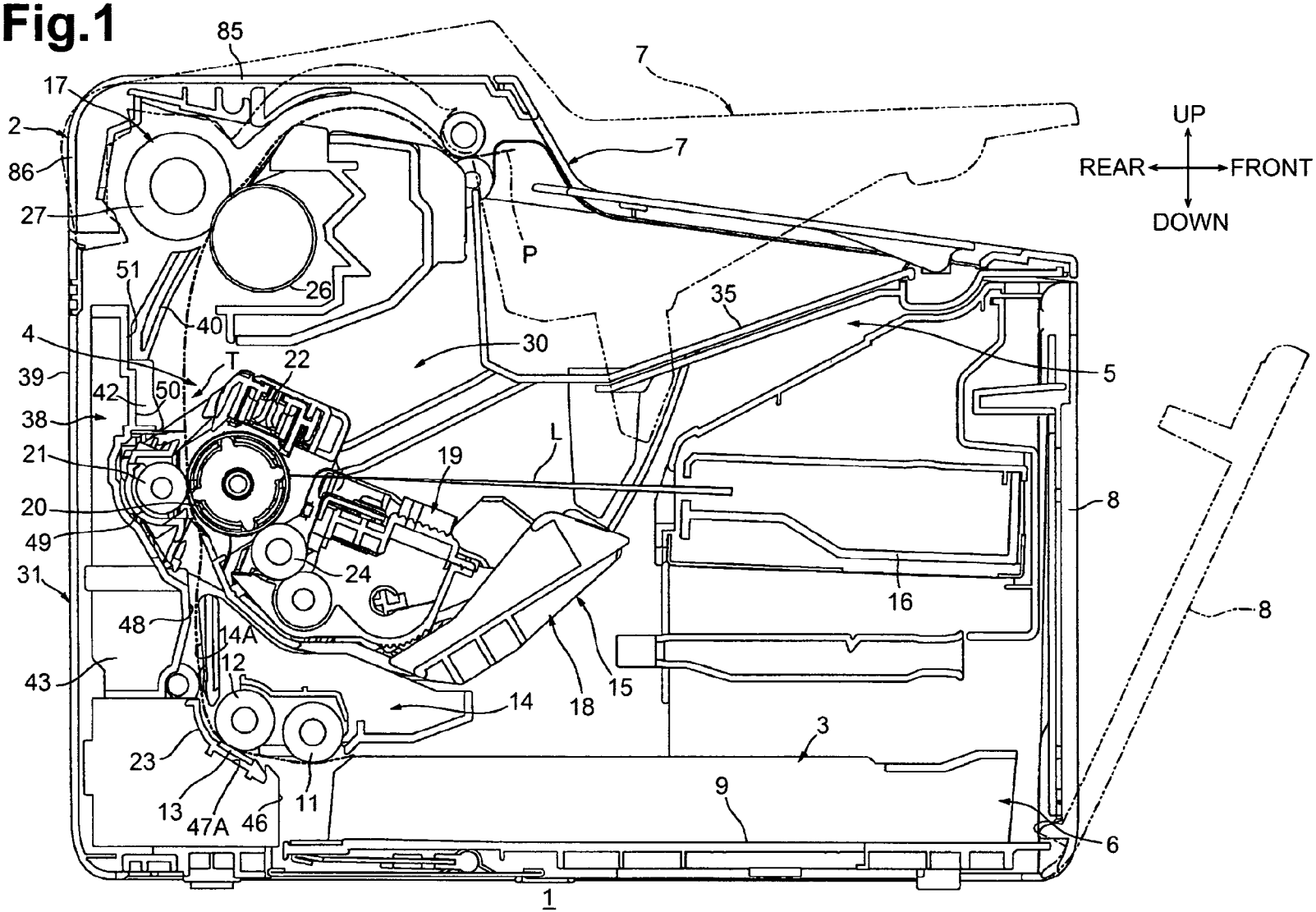
FIG. 1 is a central cross-sectional view depicting a printer as an image forming apparatus in an illustrative embodiment according to one or more aspects of the disclosure.

As depicted in FIG. 1, a printer 1, as an example of an image forming apparatus, includes a casing 2, as an example of a housing, a feed unit 3, and an image forming unit 4.

With reference to the printer 1, directions of up, down, right, left, front, and rear may be defined with reference to an orientation of the printer 1 that is disposed on a horizontal plane in which it may be intended to be used as depicted in FIG. 1. The right and left of FIG. 1 are defined as the front and rear, respectively. The right and left of the printer 1 may be defined with respect to the printer 1 viewed from the front of the printer 1. For example, a front-rear direction and a right-left direction each correspond to the horizontal direction, and an up-down direction corresponds to the vertical direction. The right-left direction is an example of an axial direction and an example of a first direction. The front-rear direction is an example of a second direction.

(1) Casing

The printer 1 further includes a top cover 7, as an example of a cover, and a front cover 8 as well as the casing 2. The casing 2 has a substantially box shape. The casing 2 has a cartridge opening 5 and a sheet opening 6.

The casing 2 has the cartridge opening 5 at its upper end portion. The cartridge opening 5 penetrates the upper end portion of the casing 2 in the up-down direction. That is, the casing 2 has an open upper end.

Figure 8:
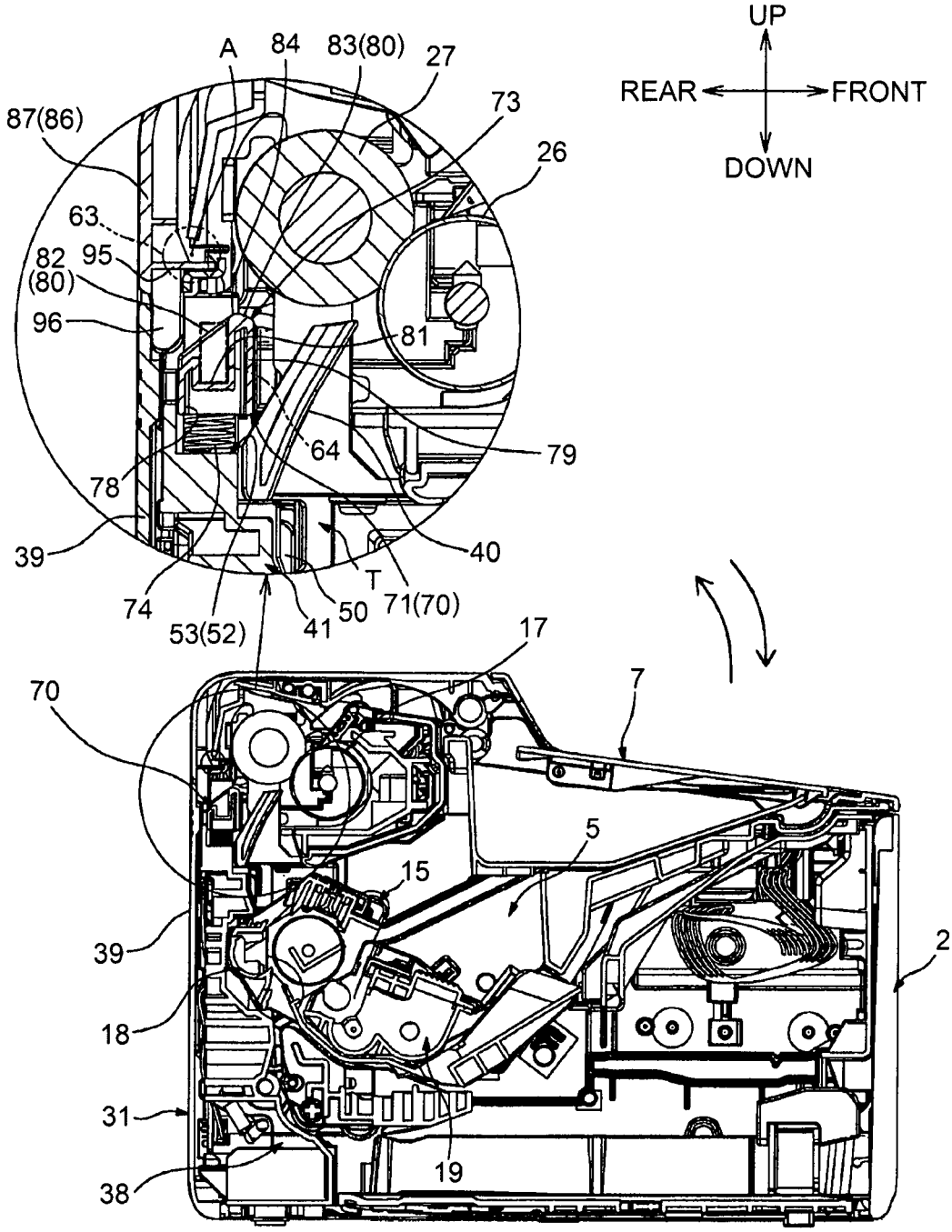
FIG. 8 is a sectional view of the printer taken along line VIII-VIII in FIG. 7 in the illustrative embodiment according to one or more aspects of the disclosure, wherein the top cover is located at the covering position.
Figure 10:
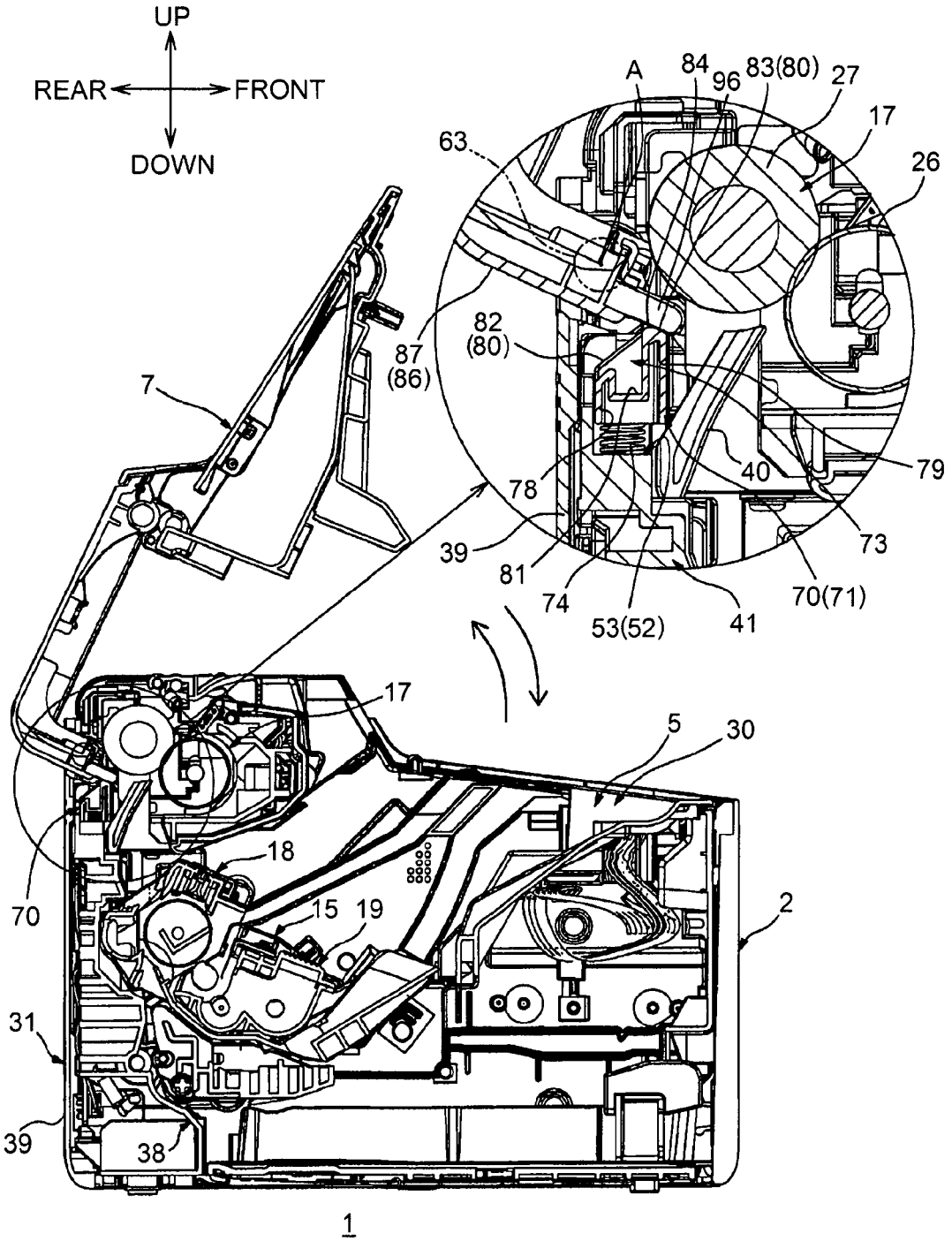
FIG. 10 is a sectional view of the printer taken along line VIII-VIII in FIG. 7 in the illustrative embodiment according to one or more aspects of the disclosure, the top cover is located at the exposing position.

The top cover 7 is disposed at the upper end portion of the casing 2. As depicted in FIGS. 8 and 10, the top cover 7 is pivotable between a covering position and an exposing position about its rear end portion. When the top cover 7 is located at the covering position, the top cover 7 covers the upper end portion of the casing 2 to conceal the cartridge opening 5. When the top cover 7 is located at the exposing position, the top cover 7 exposes the upper end portion of the casing 2 to reveal the cartridge opening 5.

As depicted in FIG. 1, the casing 2 has the sheet opening 6 at a lower portion of its front end portion. The sheet opening 6 penetrates the front end portion of the casing 2 in the front-rear direction.

The front cover 8 is disposed at the front end portion of the casing 2. The front cover 8 is pivotable between a covering position and an exposing position about its lower end portion. When the front cover 8 is located at the covering position, the front cover 8 covers the sheet opening 6. When the front cover 8 is located at the exposing position, the front cover 8 exposes the sheet opening 6. In FIG. 1, the top cover 7 and the front cover 8 located at their respective covering positions are indicated by a solid line, and the top cover 7 and the front cover 8 located between their respective covering positions and their respective exposing positions are indicated by a double-dotted-and-dashed line.

(2) Feed Unit

The feed unit 3 is configured to feed a sheet P, an example of a recording medium, to the image forming unit 4. The feed unit 3 is accommodated in a lower portion of the casing 2. The feed unit 3 includes a sheet mount 9, a feed unit frame 14, a pickup roller 11, a separation roller 12, a holder 23, and a separation pad 13.

The sheet mount 9 is disposed at a bottom in the casing 2. The sheet mount 9 is configured to communicate with the outside of the casing 2 through the sheet opening 6. In a state where the front cover 8 is located at the exposing position, an upper surface of the front cover 8 constitutes a portion of the sheet mount 9. The front cover 8 is capable of supporting a front portion (e.g., a trailing edge portion) of one or more sheets P by its upper surface and the sheet mount 9 is capable of supporting a rear portion (e.g., a leading edge portion) of the one or more sheets P while the one or more sheets P extend between the front cover 8 and the sheet mount 9 through the sheet opening 6.

The feed unit frame 14 is disposed above and is spaced from a rear end portion of the sheet mount 9. The feed unit frame 14 has a rear surface that defines a conveying path 14A extending in the up-down direction. The pickup roller 11 is rotatably supported by a lower end portion of the feed unit frame 14. The pickup roller 11 is disposed above the rear end portion of the sheet mount 9. The separation roller 12 is rotatably supported by the lower end portion of the feed unit frame 14. The separation roller 12 is disposed further to the rear than the pickup roller 11. The holder 23 is disposed diagonally below and slightly spaced from the separation roller 12. The separation pad 13 is held by the holder 23 and faces the separation roller 12.

(3) Image Forming Unit

The image forming unit 4 is configured to form an image onto a sheet P fed from the feed unit 3. The image forming unit 4 is disposed above the feed unit 3 in the casing 2.

The image forming unit 4 includes a process cartridge 15, a scanner unit 16 and a fixing unit 17 as an example of a fixing device.

The process cartridge 15 is attachable to and detachable from the casing 2 via the cartridge opening 5. The process cartridge 15 is located above the feed unit frame 14 when attached to the casing 2.

The process cartridge 15 includes a drum cartridge 18 and a developing cartridge 19. The drum cartridge 18 is attachable to and detachable from the casing 2. The developing cartridge 19 is attachable to and detachable from the drum cartridge 18.

The drum cartridge 18 includes a photosensitive drum 20 as an example of a photosensitive body, a transfer roller 21 as an example of a transfer device, and a scorotron charger 22.

The photosensitive drum 20 has a substantially cylindrical shape extending in the right-left direction. The photosensitive drum 20 is rotatably supported by a rear portion of the drum cartridge 18. The transfer roller 21 is disposed behind the photosensitive drum 20 while being in pressure contact with the photosensitive drum 20 from the rear. The scorotron charger 22 is disposed diagonally above and to the front of the photosensitive drum 20 while being spaced apart from the photosensitive drum 20.

The developing cartridge 19 is disposed diagonally below and to the front of the photosensitive drum 20. The developing cartridge 19 stores toner as an example of a developer therein. The developing cartridge 19 includes a developing roller 24. The developing roller 24 is rotatably supported by a rear end portion of the developing cartridge 19 while an upper portion and a rear portion of the developing roller 24 are exposed. The developing roller 24 is in contact with a lower front surface of the photosensitive drum 20.

The scanner unit 16 is disposed in front of the process cartridge 15 in the casing 2.

The fixing unit 17 is disposed above a rear portion of the drum cartridge 18 in the casing 2. The fixing unit 17 includes a heat roller 26, a pressing roller 27, and a conveyance guide 40. The pressing roller 27 is in pressure contact with an upper rear surface of the heat roller 26.

The conveyance guide 40 is disposed between the photosensitive drum 20 and the heat roller 26 in a sheet conveying direction. The conveyance guide 40 extends in the right-left direction while extending obliquely downward toward the rear. The conveyance guide 40 is disposed such that an upper end of the conveyance guide 40 is located diagonally below and to the rear of a contact point of the heat roller 26 and the pressing roller 27.

2. Detail of Casing

As described above, the casing 2 has a substantially box shape with an upper open end. The casing 2 includes a left sidewall 29, a right sidewall 30, and a rear wall 31.

(1) Sidewalls

Figure 2B:
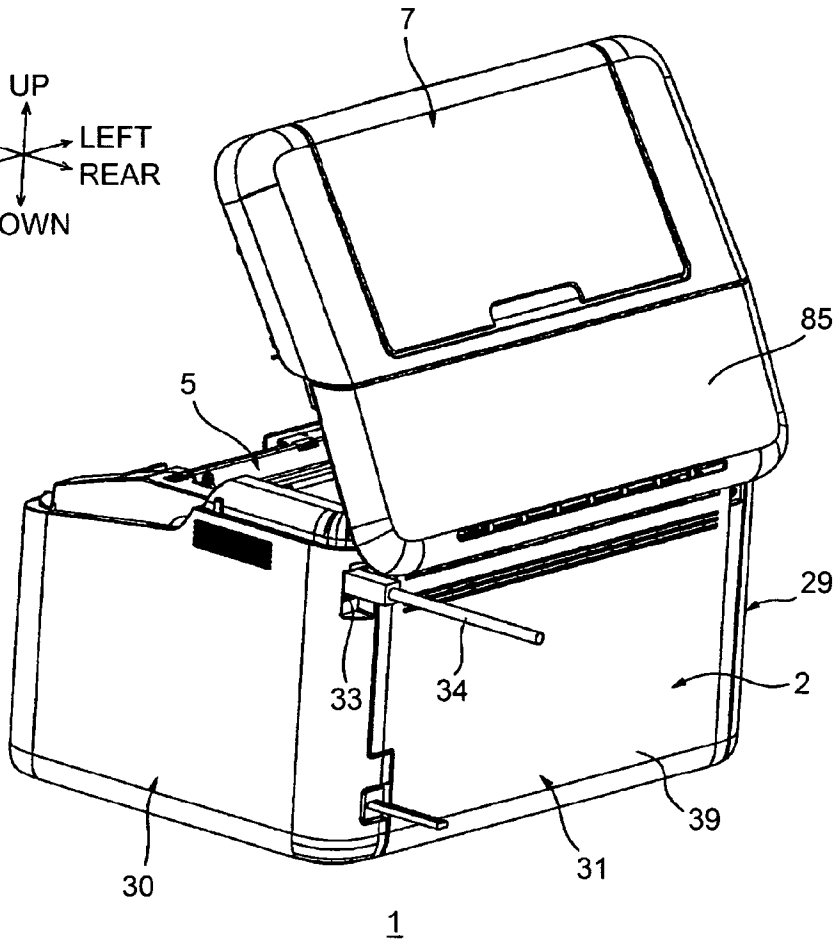
FIG. 2B is a right rear perspective view depicting the printer of FIG. 1 in the illustrative embodiment according to one or more aspects of the disclosure, wherein the top cover is located at an exposing position.
Figure 2A:
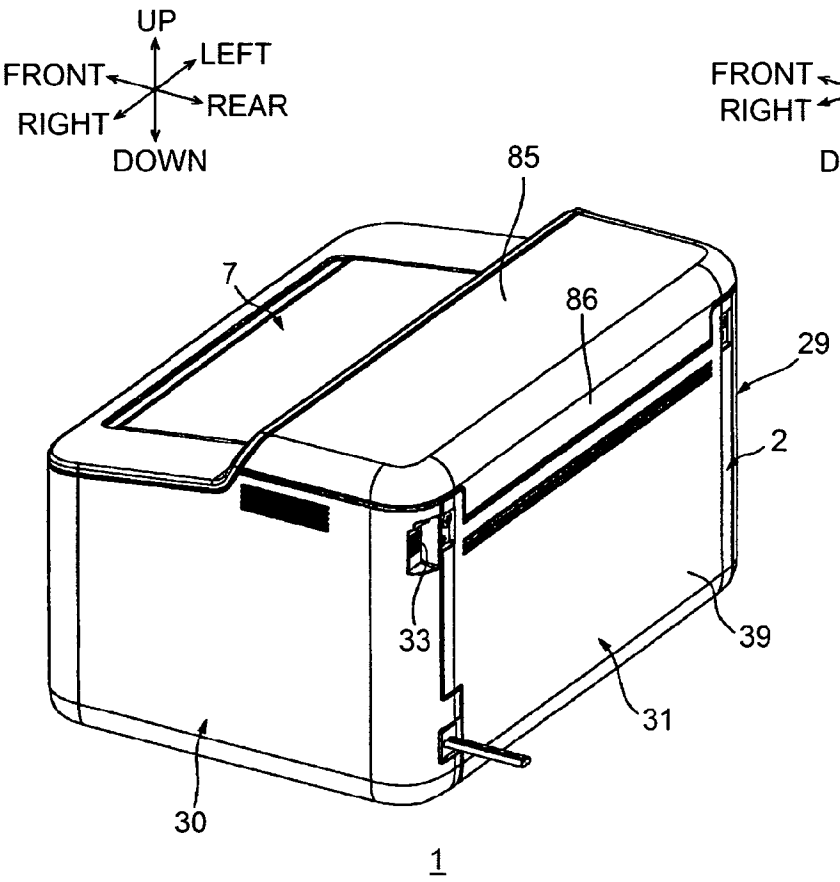
FIG. 2A is a right rear perspective view depicting the printer of FIG. 1 in the illustrative embodiment according to one or more aspects of the disclosure, wherein a top cover is located at a covering position.

As depicted in FIGS. 2A and 2B, the left sidewall 29 constitutes a left end portion of the casing 2. The right sidewall 30 constitutes a right end portion of the casing 2. The right sidewall 30 is disposed to the right of the left sidewall 29 and is spaced from the left sidewall 29. Thus, the left sidewall 29 and the right sidewall 30 are disposed facing each other across both of the feed unit 3 and the image forming unit 4 in the right-left direction. The left sidewall 29 and the right sidewall 30 each have a substantially rectangular shape in side view and extend in the front-rear direction. The left sidewall 29 and the right sidewall 30 each have a thickness in the right-left direction.

The right sidewall 30 includes a control circuit board (not depicted) and a connector 33 as an example of an external connector.

The control circuit board (not depicted) is configured to control an operation of the printer 1. The control circuit board is disposed inside of the right sidewall 30.

The connector 33 is electrically connected to the control circuit board (not depicted) and is configured to electrically connect to an external device. The connector 33 is disposed at an upper rear portion of the right sidewall 30. The connector 30 is exposed from the right sidewall 30 when viewed from the rear. The connector 33 may include, for example, a USB socket. The connector 33 is configured to receive, for example, a USB cable 34 or a USB memory (not depicted).

(2) Rear Wall

As depicted in FIG. 1, the rear wall 31 constitutes a rear end portion of the casing 2. The rear wall 31 connects a rear end of the left sidewall 29 and a rear end of the right sidewall 30. The rear wall 31 is disposed further to the rear than the feed unit 3 and the image forming unit 4.

The rear wall 31 includes a rear frame 38 as an example of a frame, and a rear cover 39.

Figure 4:
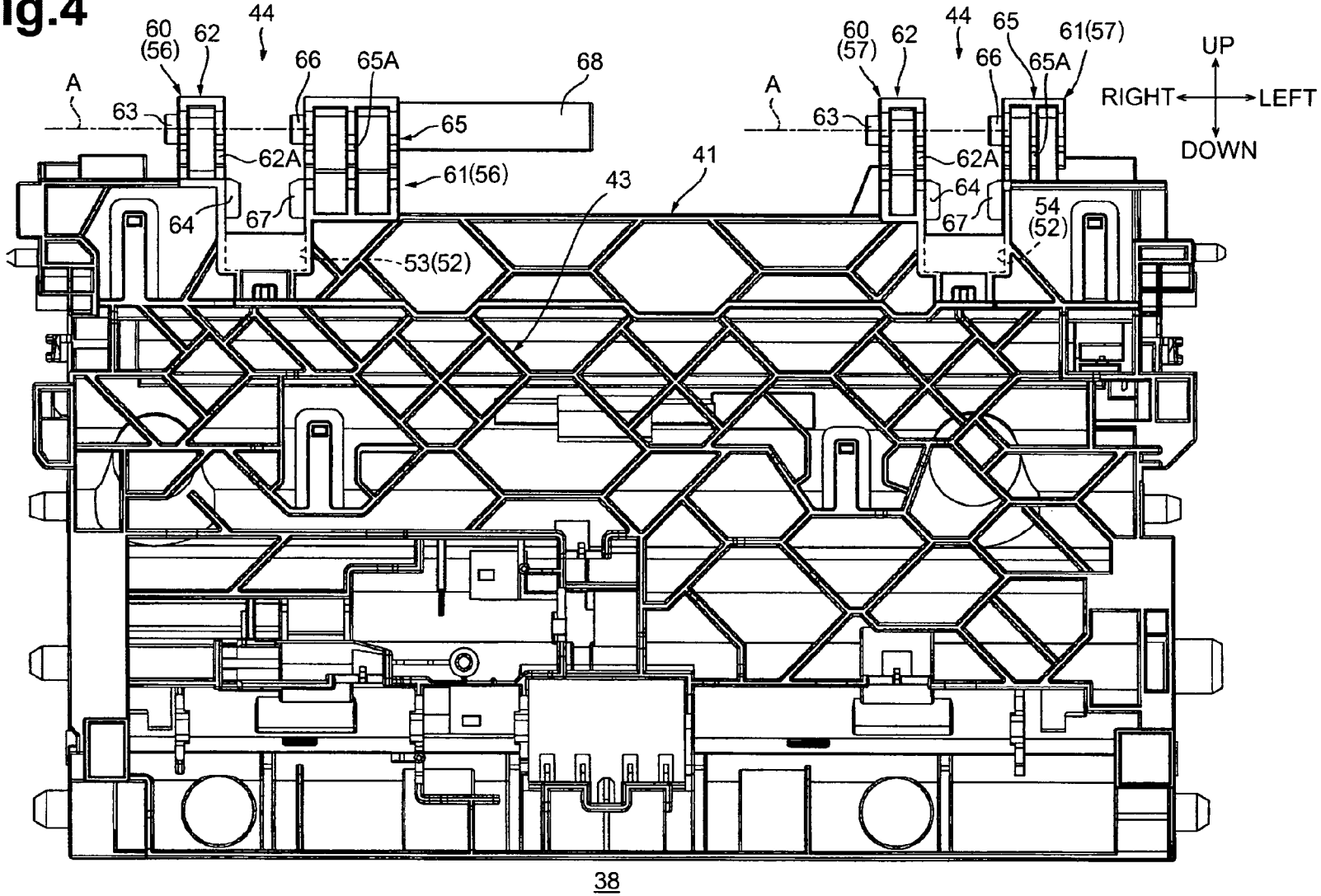
FIG. 4 is a rear view depicting a rear frame depicted in FIG. 3 in the illustrative embodiment according to one or more aspects of the disclosure.
Figure 7:
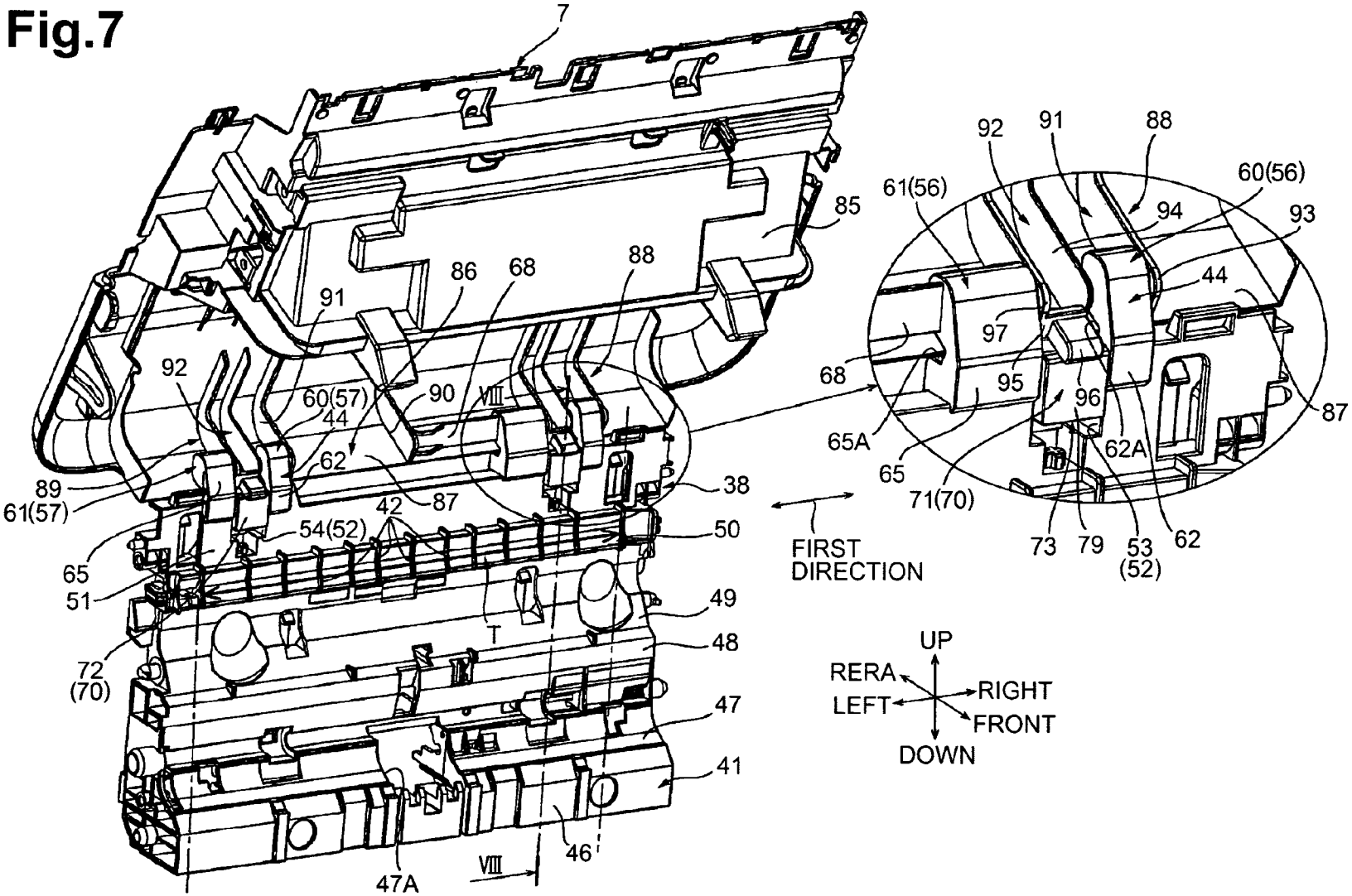
FIG. 7 is a left front perspective view depicting the rear cover and the top cover of FIG. 6C in the illustrative embodiment according to one or more aspects of the disclosure.

As depicted in FIGS. 4 and 7, the rear frame 38 may be made of resin material, for example, high impact polyethylene (HIPS). The rear frame 38 includes a frame body 41 and a frame connecting portion 44, which may constitute a one-piece assembly and may be inseparable from each other.

Figure 3:
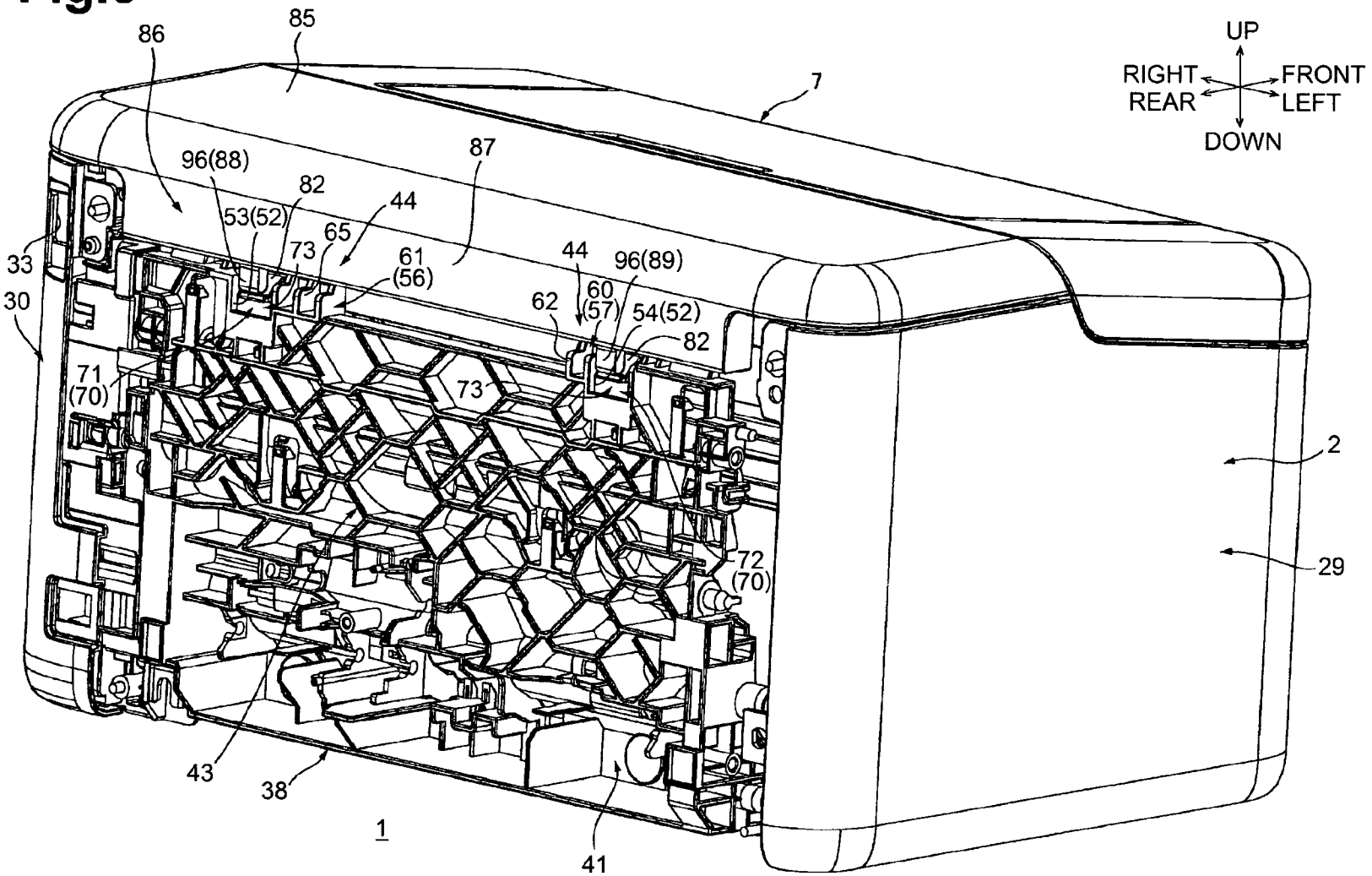
FIG. 3 is a left rear perspective view depicting the printer of FIG. 2A in the illustrative embodiment according to one or more aspects of the disclosure, wherein a rear cover is removed.

As depicted in FIG. 7, the frame body 41 has a substantially rectangular shape in front view and extends in the right-left direction. As depicted in FIG. 3, the frame body 41 has a dimension in the up-down direction that is smaller than a dimension of each of the left sidewall 29 and the right sidewall 30 in the up-down direction. The frame body 41 is disposed between a rear end portion of the left sidewall 29 and a rear end portion of the right sidewall 30 such that a lower end of the frame body 41 is located at the same level as a lower end of the left sidewall 29 and a lower end of the right sidewall 30 in the up-down direction.

As depicted in FIGS. 1 and 7, the frame body 41 has a front surface that defines an inner surface of the rear end portion of the casing 2. The frame body 41 includes a sheet alignment portion 46, a first guide section 47, a second guide section 48, a recessed portion 49, a third guide section 50, and a guide facing portion 51.

The sheet alignment portion 46 may be a lower end portion of the front surface of the frame body 41. The sheet alignment portion 46 extends in the up-down direction. As depicted in FIG. 1, the sheet alignment portion 46 is disposed diagonally below and to the rear of the pickup roller 11. The sheet alignment portion 46 is configured to align a leading edge of one or more sheets P stacked on the sheet mount 9 in the sheet conveying direction.

The first guide section 47 defines a path that extends between the pickup roller 11 and the separation roller 12. The first guide section 47 extends diagonally upward toward the rear continuously from an upper end of the sheet alignment portion 46. The first guide section 47 is configured to guide a sheet P conveyed by the pickup roller 11. The first guide section 47 extends curvedly upward toward the photosensitive drum 20 from a downstream end of the sheet alignment portion 46 in the sheet conveying direction.

As depicted in FIG. 7, the first guide section 47 has an opening 47A at a middle portion thereof in the right-left direction. The opening 47A has a substantially rectangular shape in front view. As depicted in FIG. 1, the opening 47A accommodates the holder 23 therein, and thus, the holder 23 is pivotably held by the frame body 41.

The second guide section 48 defines a path that extends between the separation roller 12 and the photosensitive drum 20 in the sheet conveying direction. The second guide section 48 extends upward from an upper end of the first guide section 47 toward the photosensitive drum 20. The second guide section 48 faces the feed unit frame 14 that holds the separation roller 12, to define the conveying path 14A therebetween.

The recessed portion 49 has a substantially curved shape in side view and extends along a rear end portion of the process cartridge 15. The recessed portion 49 is further recessed toward the rear relative to the second guide section 48. The recessed portion 49 has a lower end that is contiguous to an upper end of the second guide section 48. The recessed portion 49 is configured to, when the process cartridge 15 is attached to the casing 2, receive the rear end portion of the process cartridge 15.

The third guide section 50 as an example of a guide section defines a path that extends between the contact point of the photosensitive drum 20 and the transfer roller 21 and the fixing unit 17 in the sheet conveying direction. The third guide section 50 extends upward continuously from an upper end of the recessed portion 49. As depicted in FIG. 7, the third guide section 50 includes a plurality of ribs 42.

The ribs 42 are spaced apart from each other in the right-left direction. The ribs 42 each have a substantially rectangular shape in side view and extend in the up-down direction. The ribs 42 protrude frontward from the front surface of the third guide section 50.

The guide facing portion 51 extends upward continuously from an upper end of the third guide section 50 to an upper end of the frame body 41. The guide facing portion 51 is disposed facing a lower end portion of the conveyance guide 40. Therefore, the conveyance guide 40 extends upward from an upper end portion of the third guide section 50 toward the heat roller 26.

As depicted in FIGS. 3 and 4, the frame body 41 includes a strengthening rib 43 and a plurality of recessed supporting portions 52 an example of a supporting portion.

As depicted in FIG. 4, the strengthening rib 43 is disposed at a rear surface of the frame body 41. The strengthening rib 43 has a closed cross section in rear view and its cross section is like a honeycomb including quadrilateral cells and hexagonal cells. The strengthening rib 43 protrudes rearward from the rear surface of the frame body 41.

The recessed supporting portions 52 are disposed at the upper end portion of the frame body 41 and are spaced apart from each other in the right-left direction. As depicted in FIG. 7, the recessed supporting portions 52 are disposed so as to be included in the same area as the guide facing portion 51 when viewed from the rear or the front in the front-rear direction while being located above the third guide section 50.

The recessed supporting portions 52 each have a substantially upwardly-open U-shape in front view and are recessed downward relative to the upper end of the frame body 41. Each of the recessed supporting portions 52 has right and left end surfaces, each of which extends both in the up-down direction and in the front-rear direction.

The plurality of, e.g. two, recessed supporting portions 52 may include a first recessed supporting portion 53 and a second recessed supporting portion 54.

The first recessed supporting portion 53 may be one (e.g., the right recessed supporting portion 52) of the recessed supporting portions 52. The first recessed supporting portion 53 is defined at a right portion of the upper end portion of the frame body 41. The second recessed supporting portion 54 may be the other (e.g., the left recessed supporting portion 52) of the recessed supporting portions 52. The second recessed supporting portion 54 is defined at a left portion of the upper end portion of the frame body 41. The second recessed supporting portion 54 is disposed to the left of the first recessed supporting portion 53 and is spaced apart from the first recessed supporting portion 53.

The frame connecting portion 44 and the frame body 41 constitute a one-piece assembly and are inseparable from each other. The frame connecting portion 44 is disposed above the frame body 41. The frame connecting portion 44 includes a first frame-connecting portion 56 and a second frame-connecting portion 57.

The first frame-connecting portion 56 corresponds to the first recessed supporting portion 53. The second frame-connecting portion 57 corresponds to the second recessed supporting portion 54. The second frame-connecting portion 57 is disposed to the left of the first frame-connecting portion 56 and is spaced apart from the first frame-connecting portion 56.

The first frame-connecting portion 56 and the second frame-connecting portion 57 include respective first frame joints 60 and second frame joints 61. Each of the first frame joints 60 is disposed to the right of a corresponding one of the recessed supporting portions 52. As depicted in FIG. 4, each of the first frame joints 60 includes a first support 62, a first guide portion 64, and a first shaft portion 63 as an example of a shaft portion.

The first support 62 has a substantially rectangular column shape extending in the up-down direction. The first support 62 protrudes upward from a particular portion of the upper end of the frame body 41 and to the right of a corresponding recessed supporting portion 52. For example, the first support 62 extends from the frame body 41 toward the top cover 7.

The first support 62 has a left surface that extends both in the up-down direction and in the front-rear direction. The left surface of the first support 62 extends coplanar with the right surface of the corresponding recessed supporting portion 52.

More specifically, the first support 62 of the first frame-connecting portion 56, as an example of a first base portion, is closer to a right end of the rear frame 38 than the first recessed supporting portion 53 in the right-left direction. The left surface of the first support 62 extends coplanar with the right surface of the first recessed supporting portion 53.

The first support 62 of the second frame-connecting portion 57 is farther from a left end of the rear frame 38 than the second recessed supporting portion 54 in the right-left direction. The left surface of the first support 62 extends coplanar with the right surface of the second recessed supporting portion 54.

The first support 62 has a recess 62A at its rear surface. The recess 62A is recessed frontward relative to the rear surface of the first support 62.

The first guide portion 64 is disposed at a lower portion of the left surface of the first support 62. The first guide portion 64 has a substantially rod shape extending in the up-down direction, for example, a substantially rectangular column shape. The first guide portion 64 protrudes leftward from the left surface of the first support 62.

The first shaft portion 63 is disposed at an upper portion of a right surface of the first support 62 and at a higher position than the first guide portion 64. The first shaft portion 63 has a substantially circular column shape extending in the right-left direction. The first shaft portion 63 protrudes rightward from the right surface of the first support 62. The first shaft portion 63 is supported by the first support 62.

Each of the second frame joints 61 is disposed to the left of a corresponding one of the recessed supporting portions 52. Each of the second frame joints 61 includes a second support 65, a second guide portion 67, and a second shaft portion 66 (as another example of the shaft portion).

The second support 65 has a substantially rectangular shape extending in the up-down direction. The second support 65 protrudes upward from a particular portion of the upper end of the frame body 41, which is to the left of a corresponding recessed supporting portion 52. For example, the second support 65 extends from the frame body 41 toward the top cover 7.

The second support 65 has a right surface that extends both in the up-down direction and in the front-rear direction. The right surface of the second support 65 extends coplanar with the left surface of the corresponding recessed supporting portion 52.

More specifically, the second support 65 of the first frame-connecting portion 56 is farther from the right end of the rear frame 38 than the first recessed supporting portion 53 in the right-left direction. The right surface of the second support 65 extends coplanar with the left surface of the first recessed supporting portion 53.

The second support 65 of the second frame-connecting portion 57, as an example of a second base portion, is closer to the left end of the rear frame 38 than the second recessed supporting portion 54 in the right-left direction. The right of the second support 65 extends coplanar with the left surface of the second recessed supporting portion 54.

The second support 65 has a recess 65A at its rear surface. The recess 65A is recessed frontward relative to the rear surface of the second support 65.

The second guide portion 67 is disposed at a lower portion of the right surface of the second support 65. The second guide portion 67 is disposed to the left of the first guide portion 64 and is spaced apart from the first guide portion 64. The second guide portion 67 has a substantially rectangular shape extending in the up-down direction, for example, a substantially rectangular column shape. The second guide portion 67 protrudes rightward from the right surface of the second support 65.

The second shaft portion 66 is disposed at an upper portion of a right surface of the second support 65 and at a higher position than the second guide portion 67. The second shaft portion 66 has a substantially circular column shape extending in the right-left direction. The second shaft portion 66 protrudes rightward from the right surface of the second support 65. The second shaft portion 66 is supported by the second support 65. The second shaft portion 66 has an outside diameter that is substantially the same as an outside diameter of the first shaft portion 63.

That is, the frame connecting portion 44 includes a plurality of shaft portions, for example, the first shaft portions 63 and the second shaft portions 66, all of which protrude toward the same direction (e.g., rightward) in the right-left direction from a corresponding one of the first and second support portions 64 and 65. The first shaft portion 63 and the second shaft portion 66 each have an axis A. The axes A of the first shaft portions 63 and the axes A of the second shaft portions 66 coincide with each other.

The first frame-connecting portion 56 includes a loose preventing portion 68.

The loose preventing portion 68 is disposed at an upper portion of a left surface of the second support 65 in the first frame-connecting portion 56 and above the frame body 41 while being spaced from the frame body 41. The loose preventing portion 68 has a substantially rectangular plate-like shape in rear view and extends in the right-left direction. The loose preventing portion 68 extends leftward from the left surface of the second support 65. The loose preventing portion 68 is elastically deformable in the front-rear direction.

As depicted in FIG. 2A, the rear cover 39 has a substantially rectangular shape in rear view and extends in the right-left direction. As depicted in FIGS. 1 and 2A, the rear cover 39 is disposed behind the rear frame 38 so as to cover the rear frame 38 and a plurality of retaining mechanisms 70 all together from the rear.

3. Retaining Mechanisms

As depicted in FIG. 7, the printer 1 further includes the retaining mechanisms 70.

The retaining mechanisms 70 are supported by the rear frame 38 and are accommodated in the respective recessed supporting portions 52. The plurality of retaining mechanisms 70 includes a first retaining mechanism 71 and a second retaining mechanism 72.

The first retaining mechanism 71 corresponds to the first recessed supporting portion 53, and is disposed in the first recessed supporting portion 53. Thus, the first retaining mechanism 71 is disposed between the first support 62 and the second support 65 of the first frame-connecting portion 56 in the right-left direction. The first support 62 of the first frame-connecting portion 56 is disposed closer to the right end of the rear frame 38 than the first retaining mechanism 71 in the right-left direction.

The second retaining mechanism 72 corresponds to the second recessed supporting portion 54, and is disposed in the second recessed supporting portion 54. Thus, the second retaining mechanism 72 is disposed between the first support 62 and the second support 65 of the second frame-connecting portion 57 in the right-left direction. The second support 65 of the second frame-connecting portion 57 is disposed closer to the left end of the rear frame 38 than the second retaining mechanism 72 in the right-left direction.

As depicted in FIG. 8, each of the first retaining mechanism 71 and the second retaining mechanism 72 includes a retaining member 73 and a coil spring 74 (as an example of an urging member).

Figure 5A:
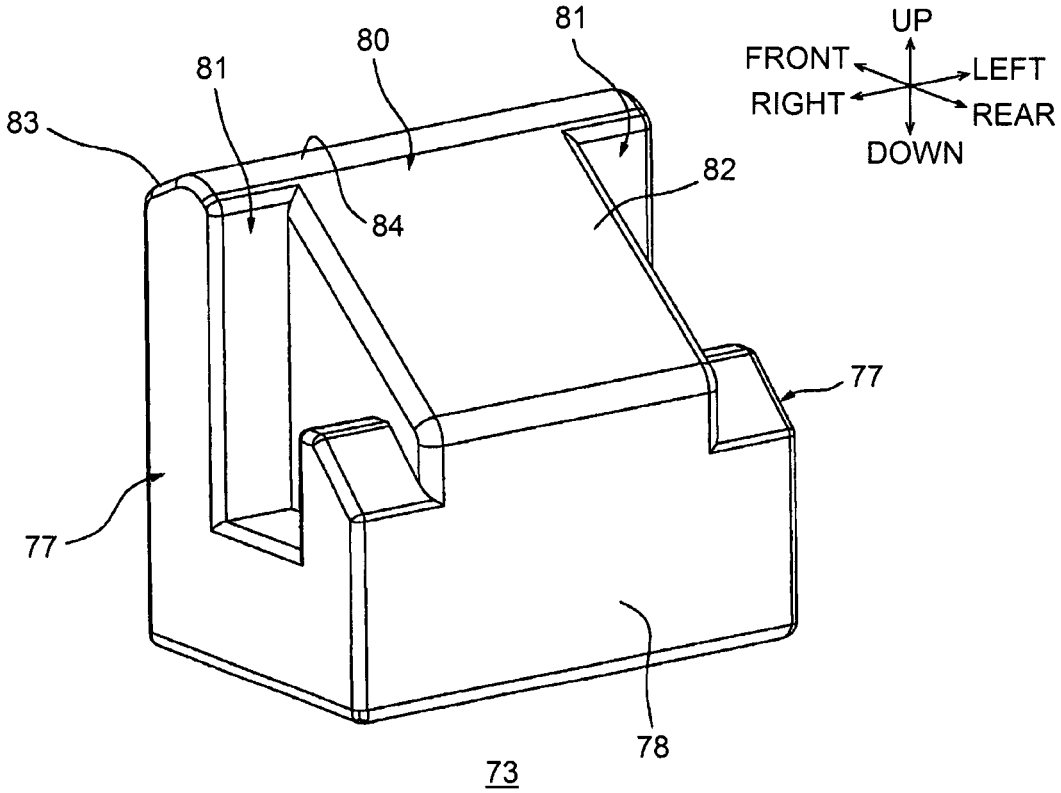
FIG. 5A is a right rear perspective view depicting one of retaining members depicted in FIG. 3 in the illustrative embodiment according to one or more aspects of the disclosure.
Figure 5B:
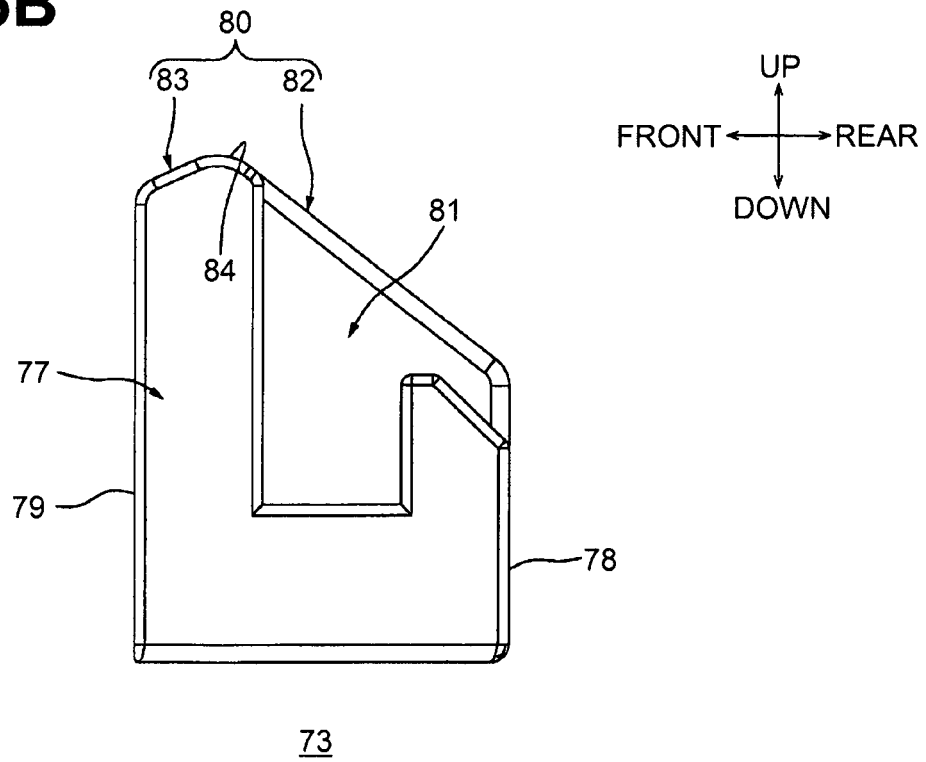
FIG. 5B is a right side view depicting the retaining member of FIG. 5A in the illustrative embodiment according to one or more aspects of the disclosure.

As depicted in FIGS. 5A and 5B, the retaining member 73 extends in the up-down direction, and has a generally rectangular cylindrical shape with a closed upper end. The retaining member 73 includes side portions 77, a front portion 79, a rear portion 78, and an upper portion 80, which constitute a one-piece body of the retaining member 73.

The side portions 77 constitute right and left end portions, respectively, of the retaining member 73. The side portions 77 are spaced apart from each other in the right-left direction. Each of the side portions 77 has a substantially trapezoidal shape in side view. In each of the side portions 77, a front end portion has a greater dimension than a rear end portion in the up-down direction.

As depicted in FIG. 8, the front portion 79 constitutes a front end portion of the retaining member 73. The front portion 79 connects between front ends of the side portions 77. As depicted in FIGS. 5A and 5B, the rear portion 78 constitutes a rear end portion of the retaining member 73. The rear portion 78 connects between rear ends of the side portions 77.

As depicted in FIGS. 5A and 5B, the upper portion 80 constitutes an upper end portion of the retaining member 73. The upper portion 80 connects between upper ends of the side portions 77. For example, as depicted in FIG. 5B, the upper portion 80 includes a first guide portion 82, a second guide portion 83, and a connecting portion 84. The connecting portion 84 connects between the first guide portion 82 and the second guide portion 83.

The first guide portion 82 constitutes a rear portion of the upper portion 80. The first guide portion 82 extends continuously from an upper end of the rear portion 78 and extends obliquely upward toward the front.

The connecting portion 84 is rounded and is convex upward. The connecting portion 84 has a substantially arc shape in side view.

The second guide portion 83 constitutes a front portion of the upper portion 80. The second guide portion 83 extends obliquely downward toward the front from the connecting portion 84. The second guide portion 83 has a front end that is contiguous with an upper end of the front portion 79.

As depicted in FIG. 5A, the retaining member 73 has a plurality of, for example, two, guide grooves 81.

The guide grooves 81 are provided at the respective side portions 77 so as to correspond to the first guide portion 64 and the second guide portion 67, respectively, of a corresponding one of the first and second frame joints 60 and 61.

As depicted in FIG. 5B, each of the guide grooves 81 has a substantially upwardly-open U-shape. The right guide groove 81 is recessed inward (e.g., leftward) relative to an outer surface of the right side portion 77 in the right-left direction. The left guide groove 81 is recessed inward (e.g., rightward) relative to an outer surface of the left side portion 77 in the right-left direction.

The retaining member 73 has substantially the same dimension as a corresponding recessed supporting portion 52 in the right-left direction.

As depicted in FIGS. 4 and 8, the retaining member 73 is disposed in a corresponding recessed supporting portion 52 such that the right guide groove 81 receives the first guide portion 64 from below and the left guide groove 81 receives the second guide portion 67 from below. For example, the first guide portion 64 and the second guide portion 67 are disposed on opposite sides of the retaining member 73, and extend in the up-down direction along the guide grooves 81.

Thus, the retaining member 73 is supported by the corresponding recessed supporting portion 52 and the frame connecting portion 44. The retaining member 73 is movable along the up-down direction while the right guide groove 81 is guided by the first guide portion 64 and the left guide groove 81 is guided by the second guide portion 67.

As depicted in FIG. 8, the coil spring 74 extends in the up-down direction. The coil spring 74 has an upper end that is fixed to a lower surface of the upper portion 80 inside the retaining member 73. The coil spring 74 has a lower end that is fixed to a bottom surface of a corresponding recessed supporting portion 52. Therefore, the coil spring 74 is disposed between the lower surface of the upper portion 80 of the retaining member 73 and the bottom surface of the corresponding recessed supporting portion 52 in a compressed state.

With this configuration, the retaining member 73 is urged upward at all times by an urging force of the coil spring 74 and is located at a first position. When the retaining member 73 is located at the first position, the retaining member 73 is restricted from moving further upward therefrom at all times while bottom surfaces of the guide grooves 81 are in contact with the lower surfaces of the first guide portion 64 and the second guide portion 67, respectively.

As depicted in FIG. 3, the retaining member 73 is disposed such that, when the retaining member 73 is located at the first position, the upper portion 80 of the retaining member 73 overlaps the connector 33 when viewed from the right or left in the right-left direction and, more specifically, the upper portion 80 of the retaining member 73 is located at a higher position than a lower end of the connector 33 in the up-down direction when viewed from the right or the left in the right-left direction.

4. Details of Top Cover

As depicted in FIG. 7, the top cover 7 includes a cover body 85 and a cover connecting portion 86.

The cover body 85 includes a stepped portion that has a level difference in the up-down direction in side view. The cover body 85 extends in the right-left direction in plan view.

As depicted in FIG. 1, the cover body 85 includes a discharge tray 35. The discharge tray 35 is disposed at a substantially middle portion of the cover body 85. The discharge tray 35 is recessed downward relative to an upper surface of the cover body 85.

The cover connecting portion 86 is disposed at a rear end portion of a lower surface of the cover body 85. As depicted in FIG. 7, the cover connecting portion 86 includes an elongated portion 87, a first cover-connecting portion 88, a second cover-connecting portion 89, and a restriction portion 90.

The elongated portion 87 has a substantially rectangular plate-like shape in front view and extends in the right-left direction. The elongated portion 87 protrudes downward from the rear end portion of the cover body 85. The elongated portion 87 has a dimension in the right-left direction that is smaller than a dimension of the cover body 85 in the right-left direction.

The first cover-connecting portion 88 corresponds to the first frame-connecting portion 56. The first cover-connecting portion 88 is disposed at a right portion of a front surface of the elongated portion 87. The second cover-connecting portion 89 corresponds to the second frame-connecting portion 57. The second cover-connecting portion 89 is disposed at a left portion of the front surface of the elongated portion 87. The second cover-connecting portion 89 is disposed to the left of the first cover-connecting portion 88 and is spaced from the first cover-connecting portion 88 in the right-left direction.

Each of the first cover-connecting portion 88 and the second cover-connecting portion 89 includes a first cover joint 91 and a second cover joint 92.

The first cover joints 91 correspond to the respective first frame joints 60. The first cover joints 91 each include a first bearing portion 93 (as an example of a bearing portion). The first bearing portion 93 has a substantially rectangular plate-like shape in side view. The first bearing portion 93 protrudes frontward from the elongated portion 87. A lower end of the first bearing portion 93 is located at the same level as a lower end of the elongated portion 87 in the up-down direction.

Figures 6A, 6B, 6C:
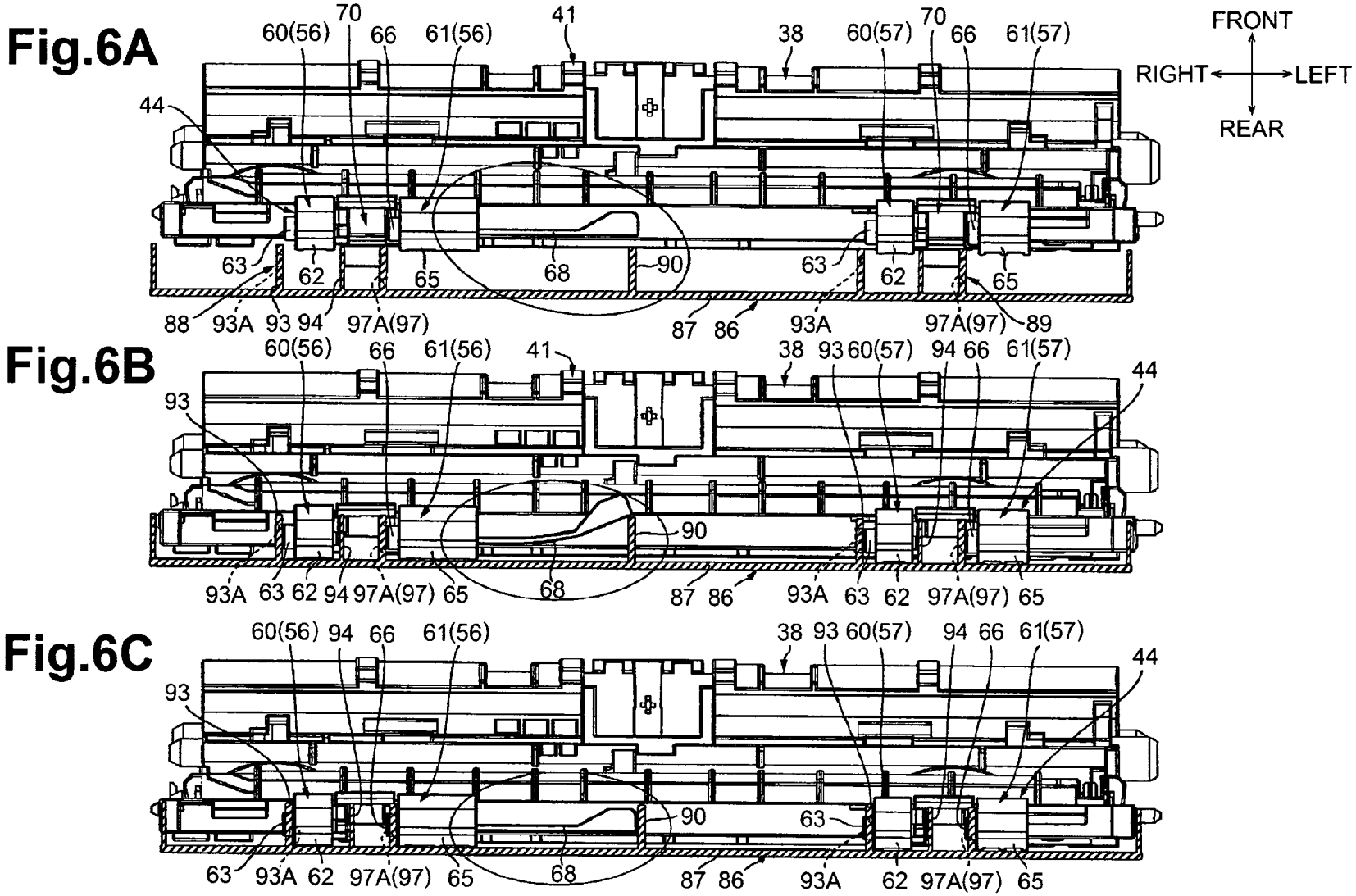
FIG. 6A is a sectional plan view for explaining a procedure for assembling the top cover to the rear frame of FIG. 1 in the illustrative embodiment according to one or more aspects of the disclosure, wherein the top cover is not yet assembled to the rear frame.
FIG. 6B is a sectional plan view for explaining the procedure for assembling the top cover to the rear frame of FIG. 1 and illustrates a step subsequent to the step of FIG. 6A in the illustrative embodiment according to one or more aspects of the disclosure, wherein the top cover is in the process of being assembled to the rear frame.
FIG. 6C is a sectional plan view for explaining the procedure for assembling the top cover to the rear frame of FIG. 1 and illustrates a step subsequent to the step of FIG. 6B in the illustrative embodiment according to one or more aspects of the disclosure, wherein the top cover is completely assembled to the rear frame.

As depicted in FIGS. 6A, 6B, and 6C, the first bearing portion 93 has a first through hole 93A. The first through hole 93A penetrates the first bearing portion 93 in the right-left direction. The first through hole 93A has a diameter that is substantially the same as the outside diameter of the first shaft portion 63.

As depicted in FIG. 7, the second cover joints 92 correspond to the respective second frame joints 61. The second cover joints 92 are disposed to the left of the respective first cover joints 91 and are spaced from the respective first cover joints 91 in the right-left direction. The second cover joints 92 each include a second bearing portion 97 (as another example of the bearing portion), a reinforcement 94, a connecting portion 95, and a contactable portion 96.

The second bearing portion 97 is disposed to the left of a corresponding first bearing portion 93 and is spaced from the first bearing portion 93 in the right-left direction. The second bearing portion 97 has a substantially rectangular plate-like shape in side view. The second bearing portion 97 protrudes frontward from the elongated portion 87. A lower end of the second bearing portion 97 is located at the same level as the lower end of the elongated portion 87 in the up-down direction.

As depicted in FIGS. 6A, 6B, and 6C, the second bearing portion 97 has a second through hole 97A. The second through hole 97A penetrates the second bearing portion 97 in the right-left direction. The second through hole 97A has a diameter that is substantially the same as the outside diameter of the second shaft portion 66. The first through hole 93A and the second through hole 97A are aligned with each other when viewed from the right or the left in the right-left direction.

As depicted in FIG. 7, the reinforcement 94 is disposed to the right of the second bearing portion 97 and is spaced from the second bearing portion 97 in the right-left direction, and thus the reinforcement 94 is disposed between the first bearing portion 93 and the second bearing portion 97. The reinforcement 94 has a substantially rectangular plate-like shape in side view. The reinforcement 94 protrudes frontward from the elongated portion 87. A lower end of the reinforcement 94 is located at the same level as the lower end of the elongated portion 87 in the up-down direction.

The connecting portion 95 has a substantially rectangular plate-like shape in bottom view. The connecting portion 95 connects between the lower end of the second bearing portion 97 and the lower end of the reinforcement 94 in the right-left direction. A rear end of the connecting portion 95 is contiguous with the lower end of the elongated portion 87.

The contactable portion 96 corresponds to a corresponding retaining mechanism 70. The contactable portion 96 is disposed at a lower surface of the connecting portion 95. As depicted in FIG. 3, the contactable portion 96 has a substantially rectangular shape plate-like shape in rear view. As depicted in FIG. 8, the contactable portion 96 protrudes downward from the lower surface of the connecting portion 95. The contactable portion 96 has a rounded lower end and has a substantially semi-circular shape in side view.

As depicted in FIG. 3, the contactable portion 96 of the first cover-connecting portion 88 corresponds to a first contactable portion. The contactable portion 96 of the second cover-connecting portion 89 is disposed to the left of the contactable portion 96 of the first cover-connecting portion 88 and is spaced from the contactable portion 96 of the first cover-connecting portion 88 in the right-left direction. The contactable portion 96 of the second cover-connecting portion 89 corresponds to a second contactable portion.

As depicted in FIG. 7, the restriction portion 90 is disposed between the first cover-connecting portion 88 and the second cover-connecting portion 89. The restriction portion 90 is disposed to the left of the second bearing portion 97 of the first cover-connecting portion 88 and is spaced from the second bearing portion 97 of the first cover-connecting portion 88 in the right-left direction. A distance between the restriction portion 90 and the second bearing portion 97 of the first cover-connecting portion 88 in the right-left direction is approximately equal to a sum of a dimension of the second support 65 of the first frame-connecting portion 56 in the right-left direction and a dimension of the loose preventing portion 68 in the right-left direction.

The restriction portion 90 has a substantially rectangular plate-like shape in side view. The restriction portion 90 protrudes frontward from the elongated portion 87.

5. Assembling of Top Cover to Casing

Hereinafter, a procedure for assembling the top cover 7 to the casing 2 will be described. In order to assemble the top cover 7 to the casing 2, as depicted in FIG. 6A, the retaining mechanisms 70 are positioned on the rear frame 38 so as to be supported by the rear frame 38 as described above.

Then, the top cover 7 is positioned such that the cover connecting portion 86 is located behind the frame connecting portion 44.

In this state, while the first bearing portions 93 are located to the right of the respective first shaft portions 63 of the first joints 60, the second bearing portions 97 are located to the right of the respective second shaft portions 66 of the second joints 61. The restriction portion 90 is located behind a left end portion of the loose preventing portion 68.

Thereafter, the top cover 7 is moved frontward. By doing so, as depicted in FIG. 6B, while a front end of the restriction portion 90 contacts the left end portion of the loose preventing portion 68 from the rear, front end portions of the first bearing portions 93 face respective right end faces of the first shaft portions 63 from the right with being spaced therebetween and front end portions of the second bearing portions 97 face respective right end faces of the second shaft portions 66 from the right with being spaced therebetween.

As the top cover 7 is moved further frontward, the loose preventing portion 68 is elastically deformed further frontward. Thus, the top cover 7 is urged leftward by an elastic force of the loose preventing portion 68.

Upon application of the elastic force of the loose preventing portion 68, the front end portions of the first bearing portions 93 come into contact with the respective right end faces of the first shaft portions 63 from the right and the front end portions of the second bearing portions 97 also come into contact with the respective right end faces of the second shaft portions 66 from the right. Thus, a leftward movement of the top cover 7 is restricted.

As the top cover 7 is moved further frontward, as depicted in FIGS. 6B and 6C, the first through holes 93A of the first bearing portions 93 face the respective first shaft portions 63 from the right and the second through holes 97A of the second bearing portions 97 face the respective second shaft portions 66 from the right.

Therefore, the right end faces of the first shaft portions 63 become separate from the respective front end portions of the first bearing portions 93 and the right end faces of the second shaft portions 66 become separate from the respective front end portions of the second bearing portions 97, whereby the top cover 7 moves to the left by the elastic force of the loose preventing portion 68. The first through holes 93A of the first bearing portions 93 receive the corresponding first shaft portions 63 such that the first shaft portions 63 are rotatable relative to the corresponding first through holes 93A, and the second through holes 97A of the second bearing portions 97 receive the corresponding second shaft portions 66 such that the second shaft portions 66 are rotatable relative to the corresponding second through holes 97A. The elastically-deformed loose preventing portion 68 is restored and thus the second support 65 of the first frame-connecting portion 56 and the loose preventing portion 68 are positioned between the second bearing portion 97 of the first cover-connecting portion 88 and the restriction portion 90.

Thus, the top cover 7 is assembled to the rear frame 38.

Figure 9:
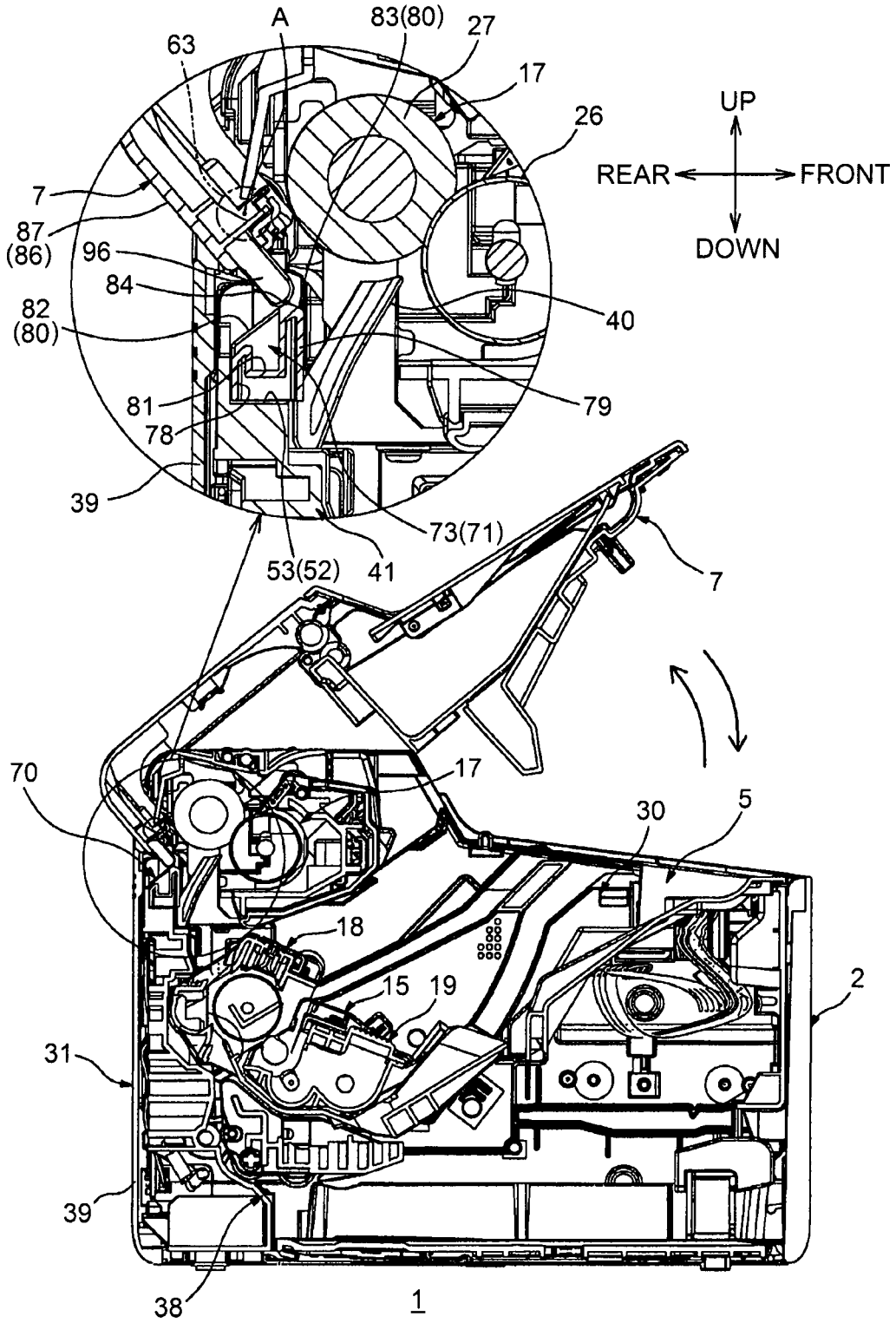
FIG. 9 is a sectional view of the printer taken along line VIII-VIII in FIG. 7 in the illustrative embodiment according to one or more aspects of the disclosure, wherein the top cover is located between the covering position and the exposing position.

As depicted in FIGS. 8, 9, and 10, the top cover 7 is capable of pivoting between the exposing position and the covering position about the axes A of the first shaft portions 63 and the axes A of the second shaft portions 66 in a state where the top cover 7 is assembled to the rear frame 38. In other words, the top cover 7 has an axis that is common to the axes A of the first and second shafts 63 and 64. The axis A of the top cover 7 vertically overlaps the retaining members 73 in the up-down direction when viewed from the right or the left in the right-left direction.

Thereafter, the position of the top cover 7 is changed to the covering position.

In this state, as depicted in FIGS. 3 and 8, the contactable portions 96 are located closer to the rear than the axis A of the top cover 7. The contactable portions 96 are disposed diagonally above and to the rear of the respective first guide portions 82 of the retaining members 73 while being spaced from the respective first guide portions 82 of the retaining members 73.

Then, the rear cover 39 is attached to the rear frame 38 depicted in FIG. 3 from the rear, and then the rear cover 39 is fastened to the rear frame 38 using screws.

Through the above-described procedure, the assembling of the top cover 7 to the casing 2 is completed.

6. Opening and Closing of Top Cover

A procedure for opening and closing the top cover 7 will be described. Hereinafter, the opening and closing procedure will be described with reference to the first frame-connecting portion 56, the first cover-connecting portion 88, and the first retaining mechanism 71. It is noted that, when the top cover 7 is opened or closed, the second frame-connecting portion 57, the second cover-connecting portion 89, and the second retaining mechanism 71 may behave in a manner similar to and simultaneous with the first frame-connecting portion 56, the first cover-connecting portion 88, and the first retaining mechanism 71.

(1) Pivoting of Top Cover from Covering Position to Exposing Position

In order to pivot the top cover 7 from the covering position to the exposing position, as depicted in FIG. 8, an operator lifts a front end portion of the top cover 7 obliquely upward toward the rear.

By doing so, as depicted in FIGS. 8 and 9, the top cover 7 is pivoted counterclockwise about its axis A from the covering position toward the exposing position.

In accordance with the pivot of the top cover 7, the contactable portion 96 moves obliquely upward toward the front and thus the lower end portion of the contactable portion 96 comes into contact with the first guide portion 82 of the retaining member 73 from the rear. Then, the top cover 7 is pivoted further counterclockwise, the contactable portion 96 moves obliquely upward toward the front while the lower end portion of the contactable portion 96 slides relative to the first guide portion 82 along the slope of the first guide portion 82.

At that time, the retaining member 73 is pressed obliquely downward toward the front by the contactable portion 96 sliding relative to the first guide portion 82. Thus, the retaining member 73 is gradually moved downward from the first position against the urging force of the coil spring 74 while the guide grooves 81 of the retaining member 73 are guided by the first guide portion 64 and the second guide portion 67, respectively.

As depicted in FIG. 9, when the lower end of the contactable portion 96 reaches the connecting portion 84 of the retaining member 73, the retaining member 73 is located at a second position which is the lowest position at which the retaining member 37 may be located.

Thereafter, as depicted in FIG. 10, as the top cover 7 is further pivoted counterclockwise, the lower end portion of the contactable portion 96 moves over the connecting portion 84, and further moves obliquely upward toward the front along the slope of the second guide portion 83 while sliding relative to the second guide portion 83.

While the contactable portion 96 slides relative to the second guide portion 83, the retaining member 73 is gradually moved upward from the second position by the urging force of the coil spring 74.

When the top cover 7 reaches the exposing position, the lower end portion of the contactable portion 96 is located closer to the front than the retaining member 73 and the contactable portion 96 thus becomes unable to further slide relative to the second guide portion 83. In this state, the coil spring 74 urges the retaining member 73 toward the contactable portion 96 and the second guide portion 83 of the retaining member 73 is in contact with the contactable portion 96 from below.

Therefore, the top cover 7 is restricted from pivoting from the exposing position to the covering position. That is, the retaining mechanism 70 retains the top cover 7 at the exposing position.

Thus, the movement of the top cover 7 from the covering position to the exposing position is completed.

In the state where the top cover 7 is located at the exposing position, as depicted in FIG. 7, the lower end of the elongated portion 87 of the cover connecting portion 86 are received by the recesses 62A of the first supports 62 and the recesses 65A of the second supports 65. As depicted in FIGS. 2B and 3, the connector 33 is uncovered by the top cover 7 when viewed from the rear.

(2) Pivoting of Top Cover from Exposing Position to Covering Position

In order to move the top cover 7 from the exposing position to the covering position, the procedure for pivoting the top cover 7 from the covering position to the exposing position is performed in reverse.

For example, as depicted in FIG. 10, the operator moves the front end portion of the top cover 7 obliquely downward toward the front. Thus, the top cover 7 is pivoted clockwise about its axis A from the exposing position toward the covering position.

Therefore, the contactable portion 96 presses the second guide portion 83 of the retaining member 73 obliquely downward toward the rear. Upon application of the pressure, the retaining member 73 gradually moves downward against the urging force of the coil spring 74 while the guide grooves 81 of the retaining member 73 are guided by the first guide portion 64 and the second guide portion 67, respectively.

Thereafter, as depicted in FIG. 9, the lower end portion of the contactable portion 96 slides relative to the second guide portion 83 and thus reaches the connecting portion 84. When the lower end portion of the contactable portion 96 is in contact with the connecting portion 84, the retaining member 73 is located at the second position.

As the top cover 7 is pivoted further counterclockwise, the lower end portion of the contactable portion 96 moves over the connecting portion 84 and reaches the first guide portion 82. Then, the lower end portion of the contactable portion 96 moves obliquely downward toward the rear along the slope of the first guide portion 82 while sliding relative to the first guide portion 82.

At that time, the retaining member 73 is gradually moved upward by the urging force of the coil spring 74 while the first guide portion 82 of the retaining member 73 slides relative to the lower end of the contactable portion 96.

When the top cover 7 reaches the covering position, as depicted in FIG. 8, the contactable portion 96 and the first guide portion 82 are disengaged from each other. Therefore, the retaining member 73 is moved upward by the urging force of the coil spring 74 and thus is located at the first position.

Thus, the pivoting of the top cover 7 from the exposing position to the covering position is completed.

7. Image Formation

In the printer 1, as depicted in FIG. 1, image formation is performed by control of a controller (not depicted).

As image formation starts, the scorotron charger 22 charges a surface of the photosensitive drum 20 uniformly. Then, the scanner unit 16 emits a laser beam L based on image data to the surface of the photosensitive drum 20 to expose the surface of the photosensitive drum 20. Thus, an electrostatic latent image based on the image data is formed on the surface of the photosensitive drum 20.

The developing roller 24 supplies toner onto the electrostatic latent image formed on the surface of the photosensitive drum 20 from the developing cartridge 19. The photosensitive drum 20 thus holds a toner image (as an example of a developer image) on the surface thereof.

The pickup roller 11 rotates to feed one or more sheets P stacked on the sheet mount 9 to between the separation roller 12 and the separation pad 13. Then, the separation roller 12 rotates to separate the one or more sheets P fed by the pickup roller 11 into a single sheet and convey the separated sheet P, one by one, into the conveying path 14A. Thus, the one or more sheets P are fed one by one to between the photosensitive drum 20 and the transfer roller 21 at predetermined timings. When a fed sheet P passes between the photosensitive drum 20 and the transfer roller 21, the transfer roller 21 transfers the toner image onto the sheet P from the surface of the photosensitive drum 20.

Thereafter, the plurality of ribs 42 of the third guide section 50 guides the sheet P having the toner image transferred thereon toward the conveyance guide 40, and the conveyance guide 40 further guides the sheet P toward the fixing unit 17. For example, the frame body 41 includes the third guide section 50 at a guide area T that extends in the right-left direction. The third guide section 50 is configured to guide a sheet P toward the fixing unit 17 from the transfer roller 21. The guide area T refers to an area defined in FIG. 7. Within the guide area T refers to within an imaginary area defined by extension lines extending in the up-down direction from right and left ends, respectively, of the third guide section 50 when the rear frame 38 is viewed from the front. The right-left direction is an example of the first direction.

As depicted in FIGS. 7 and 8, while the retaining mechanism 70 and the frame connecting portion 44 are disposed within the guide area T in the right-left direction, the retaining mechanism 70 and the frame connecting portion 44 are located further to the rear than the guide area T in the front-rear direction and above the guide area T in the up-down direction. As the sheet P guided by the conveyance guide 40 reaches a position between the heat roller 26 and the pressing roller 27, the heat roller 26 and the pressing roller 27 thermally fix the toner image transferred onto the sheet P by heat and pressure. Thereafter, the sheet P is discharged onto the discharge tray 35 of the top cover 7 by various rollers.

As described above, a sheet P is fed from the sheet mount 9 and passes between the photosensitive drum 20 and the transfer roller 21. Then, the sheet P passes between the heat roller 26 and the pressing roller 27, and is discharged onto the discharge tray 35. For example, a sheet P is conveyed in a conveying path having a substantially C-shape in side view.

8. Effects (1) In the printer 1, as depicted in FIG. 10, while the retaining member 73 is urged toward the contactable portion 96 by the coil spring 74, the retaining member 73 restricts the top cover 7 from moving from the exposing position toward the covering position by contacting the contactable portion 96 of the top cover 7 located at the exposing position. Therefore, the retaining member 73 may retain the top cover 7 at the exposing position.

As depicted in FIGS. 4 and 7, the rear frame 38 of the casing 2 includes the first shaft portions 63 and the second shaft portions 66, and is configured to support the retaining mechanisms 70, whereby the first shaft portions 63, the second shaft portions 66, and the retaining mechanisms 70 may be disposed adjacent to each other easily.

Therefore, while the rear frame 38 has such a simple configuration, the pivot axis of the top cover 7 and the retaining mechanisms 70 may be located close to each other, thereby reducing or preventing deformation of the rear frame 38 including the third guide section 50 due to the urging force of the coil springs 74. Accordingly, a conveyance accuracy of a sheet P may be improved.

According to the illustrative embodiment, the deformation of the rear frame 38 may be reduced or prevented, whereby an abnormal sound might not come from the rear frame 38 when the top cover 7 is moved between the exposing position and the covering position.

(2) As depicted in FIG. 7, the retaining mechanisms 70, the first shaft portions 63, the second shaft portions 66, the first bearing portions 93, and the second bearing portions 97 are located within the guide area T in the right-left direction. Therefore, the printer 1 may be reduced in size in the right-left direction.

While the retaining mechanisms 70, the first shaft portions 63, the second shaft portions 66, the first bearing portions 93, and the second bearing portions 97 are within the guide area T in the right-left direction, the retaining mechanisms 70, the first shaft portions 63, and the second shaft portions 66 are supported by the rear frame 38. Therefore, deformation of the rear frame 38 may be reduced or prevented, thereby reducing or preventing deformation of the third guide section 50 disposed within the guide area T.

(3) As deformation of the rear frame 38 including the third guide section 50 is reduced or prevented as described above, the third guide section 50 may guide a sheet P accurately from the transfer roller 21 to the fixing unit 17 as depicted in FIG. 1. Therefore, an image formation failure may be reduced or prevented.

(4) As depicted in FIG. 4, each of the recessed supporting portions 52 for supporting the respective retaining members 73 extends contiguously from a corresponding one of the first supports 62 supporting the respective first shaft portions 63. Therefore, the retaining members 73 may be located adjacent to the respective corresponding first shaft portions 63 surely, whereby the retaining members 73 and the pivot axis of the top cover 7 may be surely located close to each other. Accordingly, deformation of the rear frame 38 including the third guide section 50 may be surely reduced or prevented.

(5) As depicted in FIG. 8, the first guide portion 64 guides the retaining member 73, whereby a smooth movement of the retaining member 73 may be ensured.

As depicted in FIG. 4, each of the first shaft portions 63 is disposed above a corresponding one of the first guide portions 64 and supported by a corresponding one of the first supports 62. Therefore, in the right-left direction, the pivot axis of the top cover 7 and the retaining members 73 may be further surely located close to each other.

(6) As depicted in FIGS. 4 and 7, in each of the first frame-connecting portion 56 and the second frame-connecting portion 57, the second guide portion 67 is disposed opposite to the first guide portion 64 relative to the retaining member 73 and extends toward the top cover 7 along one of the guide grooves 81 of the retaining member 73. Therefore, the second guide portion 67 may guide the movement of the retaining member 73, whereby a stable movement of the retaining member 73 may be ensured.

(7) As depicted in FIGS. 6A, 6B, and 6C, the first shaft portions 63 and the second shaft portions 66 all protrude in the same direction with respect to the right-left direction. Therefore, when the top cover 7 is moved in an appropriate direction with respect to the right-left direction such that the first shaft portions 63 and the second shaft portions 66 may be received by the first bearing portions 93 and the second bearing portions 97, respectively, the first shaft portions 63 and the second shaft portions 66 may be received by the first bearing portions 93 and the second bearing portions 97, respectively, at the same time.

Therefore, the top cover 7 may be assembled to the casing 2 smoothly.

(8) As depicted in FIG. 8, when viewed from the right or the left in the right-left direction, the axis A of the first shaft portion 63 vertically overlaps the retaining member 73 in the up-down direction. Therefore, the pivot axis of the top cover 7 and the retaining member 73 may be further surely located close to each other in the front-rear direction.

(9) As depicted in FIG. 3, two contactable portions 96 are disposed while being spaced from each other in the right-left direction, and the retaining mechanisms 70 include two retaining mechanisms, e.g., the first retaining mechanism 71 and the second retaining mechanism 72, so as to correspond to the respective contactable portions 96. Therefore, the top cover 7 may be further surely retained at the exposing position.

(10) As depicted in FIG. 7, the top cover 7 is assembled to the rear frame 38 by moving the top cover 7 in a particular single direction, which is the same direction relative to the first retaining mechanism 71 and the second retaining mechanism 72, with respect to the right-left direction. Therefore, as compared with a case where the top cover 7 is assembled to the rear frame 38 by moving the top cover 7 in two or more different directions relative to the first retaining mechanism 71 and the second retaining mechanism 72 with respect to the right-left direction, the assembling procedure according to the illustrative embodiment may surely reduce or prevent deformation of the rear frame 38.

(11) As depicted in FIG. 2B, in a state where the top cover 7 is located at the exposing position, the connector 33 is uncovered by the top cover 7 when viewed from the rear. Therefore, even when the connector 33 has the USB cable 34 connected therewith, the top cover 7 may be able to be located at the exposing position. Accordingly, a design flexibility of the connector 33 may be ensured.

9. Variations

In the illustrative embodiment, the frame connecting portion 44 includes the shaft portions, e.g., the first shaft portions 63 and the second shaft portions 66, and the cover connecting portion 86 includes the bearing portions, e.g., the first bearing portions 93 and the second bearing portions 97. Nevertheless, in other embodiments, for example, the frame connecting portion 44 may include bearing portions and the cover connecting portion 86 may include shaft portions.

In the illustrative embodiment, each of the first frame-connecting portion 56 and the second frame-connecting portion 57 includes both of the first support 62 and the second support 65. That is, the frame connecting portion 44 includes four supports. Nevertheless, in other embodiments, for example, the number of supports might not be limited to the specific example. Any number more than or equal to one (e.g., two, three, or more than four) may be applicable.

Each of the first frame-connecting portion 56 and the second frame-connecting portion 57 may include one of the first support 62 and the second support 65. In one example, the first frame-connecting portion 56 may include the first support 62 only and the second frame-connecting portion 57 may include the second support 65 only. In another example, the first frame-connecting portion 56 may include the second support 65 only and the second frame-connecting portion 57 may include the first support 62 only.

Each of the variations may also provide the same effect as the illustrative embodiment.

What is claimed is:

1. An image forming apparatus comprising:

a casing;

a cover configured to pivot between a covering position in which the cover covers an upper end portion of the casing and an exposing position in which the cover exposes the upper end portion of the casing;

a shaft portion provided to one of the casing and the cover and extending in an axial direction parallel to a pivot axis;

a bearing portion provided to the other one of the casing and the cover; and a retaining mechanism configured to retain the cover at the exposing position, wherein the cover includes a contactable portion, the contactable portion being spaced from the retaining mechanism when the cover is at the covering position, the contactable portion being configured to, when the cover pivots between the covering position and the exposing position, contact the retaining mechanism, wherein the retaining mechanism includes a retaining member and an urging member, the retaining member being configured to restrict the cover from pivoting from the exposing position to the covering position, the urging member urging the retaining member toward the contactable portion, wherein the casing includes a frame, the frame supporting the retaining mechanism, the frame including a guide section and one of the shaft portion and the bearing portion, the guide section being configured to guide a sheet, and wherein the shaft portion, the bearing portion, and the retaining mechanism are disposed above the guide section.

2. The image forming apparatus according to claim 1, wherein the guide section is disposed at a guide area that extends in a first direction parallel with the axial direction of the shaft portion, and wherein the retaining mechanism, the shaft portion, and the bearing portion are located within the guide area in the first direction.

3. The image forming apparatus according to claim 1, further comprising:

a photosensitive body configured to hold a developer image thereon;

a transfer device configured to transfer the developer image from the photosensitive body onto a sheet; and a fixing device configured to fix the developer image transferred onto the sheet, wherein the guide section of the frame is disposed between the transfer device and the fixing device.

4. The image forming apparatus according to claim 1, wherein the frame includes a supporting portion and a first base portion, the supporting portion being configured to support the retaining member such that the retaining member moves vertically, the first base portion supporting one of the shaft portion and the bearing portion and extending contiguously from the supporting portion toward the cover.

5. The image forming apparatus according to claim 4, wherein the first base portion includes a first guide portion configured to guide the retaining member along a side portion of the retaining member, the first base portion including one of the shaft portion and the bearing portion being disposed above the first guide portion.

6. The image forming apparatus according to claim 5, wherein the frame of the casing is disposed opposite to the first guide portion relative to the retaining member and includes a second guide portion, the second guide portion extending along the side portion of the retaining member toward the cover.

7. The image forming apparatus according to claim 6, further comprising a further shaft portion provided to one of the casing and the cover, wherein the shaft portion and the further shaft portion protrude toward a same direction in the axial direction.

8. The image forming apparatus according to claim 1, wherein an axis of the shaft portion vertically overlaps the retaining member when the shaft portion is viewed in the axial direction.

9. The image forming apparatus according to claim 1, wherein the contactable portion includes a first contactable portion and a second contactable portion spaced from the first contactable portion in a first direction parallel with the axial direction of the shaft portion, wherein the retaining mechanism include a first retaining mechanism facing the first contactable portion and a second retaining mechanism facing the second contactable portion, and wherein the frame includes a first base portion provided to a side portion of the first retaining mechanism and a second base portion provided to a side portion of the second retaining mechanism.

10. An image forming apparatus comprising:

a casing;

a cover configured to pivot between a covering position in which the cover covers an upper end portion of the casing and an exposing position in which the cover exposes the upper end portion of the casing;

a shaft portion provided to one of the casing and the cover;

a bearing portion provided to the other one of the casing and the cover;

a retaining mechanism configured to retain the cover at the exposing position;

a further shaft portion; and a further bearing portion, wherein the cover includes a contactable portion configured to, when the cover pivots between the covering position and the exposing position, contact the retaining mechanism, wherein the retaining mechanism includes a retaining member and an urging member, the retaining member being configured to restrict the cover from pivoting from the exposing position to the covering position, the urging member urging the retaining member toward the contactable portion, wherein the casing includes a frame, the frame including a guide section configured to guide a sheet, wherein the frame of the casing includes one of the shaft portion and the bearing portion and supports the retaining mechanism, wherein the contactable portion includes a first contactable portion and a second contactable portion spaced from the first contactable portion in one direction parallel with an axial direction of the shaft portion, wherein the retaining mechanism include a first retaining mechanism facing the first contactable portion and a second retaining mechanism facing the second contactable portion, and wherein the frame includes a first base portion provided to a side portion of the first retaining mechanism and a second base portion provided to a side portion of the second retaining mechanism, wherein the first base portion is disposed closer to an end of the frame of the casing than the first retaining mechanism in one direction and includes at least one of the shaft portion, the further shaft portion, the bearing portion, and the further bearing portion, and wherein the second base portion is disposed closer to an end of the frame of the casing than the second retaining mechanism in the one direction and includes at least one of the shaft portion, the further shaft portion, the bearing portion, and the further bearing portion.

11. The image forming apparatus according to claim 1, further comprising an external connector configured to electrically connect to an external device, wherein the external connector is disposed such that at least a portion of the external connector overlaps the retaining mechanism when viewed in a first direction parallel with the axial direction, and wherein, when the cover is at the exposing position, the external connector is uncovered when viewed in a second direction perpendicular to the first direction and a vertical direction.

12. The image forming apparatus according to claim 1, wherein the cover includes the bearing portion, and wherein the frame of the casing includes the shaft portion.

* * * * *